US005227843A

United States Patent [19]

Yamamoto et al.

[11] Patent Number: 5,227,843

[45] Date of Patent: Jul. 13, 1993

[54] DRIVE TRANSMISSION SYSTEM FOR A PROCESS CARTRIDGE USED IN AN IMAGE FORMING APPARATUS

[75] Inventors: Shunji Yamamoto; Hiromitsu Saijo; Yukio Tokura; Hideji Hayashi, all of Osaka, Japan

[73] Assignee: Minolta Camera Kabushiki Kaisha, Osaka, Japan

[21] Appl. No.: 549,150

[22] Filed: Jul. 6, 1990

[30] Foreign Application Priority Data

Jul. 7, 1989 [JP] Japan ..... 1-176018

[51] Int. Cl.[5] ..... G03G 15/00

[52] U.S. Cl. ..... 355/210; 355/317

[58] Field of Search ..... 355/200, 210, 211, 212, 355/317

[56] References Cited

U.S. PATENT DOCUMENTS 4,254,202 3/1981 Matsumoto et al. ..... 430/120
4,609,276 9/1986 Mitzutani ..... 355/210
4,702,587 10/1987 Miyoshi ..... 355/200
4,769,669 9/1988 Watanabe ..... 355/200
4,806,968 2/1989 Watanabe et al. ..... 355/200
4,896,191 1/1990 Ohyabu et al. ..... 355/309

FOREIGN PATENT DOCUMENTS 57-139764 8/1972 Japan .

*Primary Examiner*—A. T. Grimley
*Assistant Examiner*—J. E. Barlow, Jr.
*Attorney, Agent, or Firm*—Burns, Doane, Swecker & Mathis

[57] ABSTRACT

A detachable imaging unit is provided in an image forming device. The detachable unit includes an image bearing member, one of a pair of registration rollers and a developing device. A relative position between the image bearing member and the one of the pair of registration rollers is provided so as to permit precise transport of a recording sheet against the image bearing member.

9 Claims, 5 Drawing Sheets

DRIVE TRANSMISSION SYSTEM FOR A PROCESS CARTRIDGE USED IN AN IMAGE FORMING APPARATUS

BACKGROUND OF THE INVENTION

1. Field of the Invention

The present invention relates to an image forming apparatus for copying machine and printers and the like.

2. Description of the Related Art

A requirement of the image forming apparatus used in copying machines and printers and the like is the periodic replacement, inspection and adjustment of consumable components such as the photoconductive drum used as a carrier for an electrostatic latent image and the toner accommodated in the developing unit that develops the electrostatic latent image formed on the surface of the photoconductive drum, the aforesaid servicing being performed by a specialist technician. Accordingly, it is extremely troublesome so send for the service technician each time servicing is required. Recent efforts to simplify replacement, inspection and adjustment of each component of the device have led to image forming apparatus wherein the photoconductive drum required for image formation and the developing means for developing the electrostatic latent image formed on the surface of said photoconductive drum in accordance with the image information have been integrated into a single unit that is removable from the image forming apparatus.

On the other hand, the aforesaid image forming apparatus require precise maintenance of the positional relationships of paper supplying devices such as registration rollers to regulate the timing transported transfer material and the processing means such the photoconductive drum in order to align the leading edge of the toner image formed on the surface of the photoconductive drum with the leading edge of the transfer material transported from the paper supplying device so as to assure an accurate transfer. Thus, conventional image forming apparatus are constructed with a frame that is capable of being pulled out from the apparatus, said frame supporting removable processing means such as the photoconductive drum and a pair of registration rollers (as disclosed in Japanese Patent Application No. 57-139764).

Although inspection and replacement of the processing means such as the photoconductive drum are simplified and adjustment of the positional relationship of the processing means and paper supplying means is also simplified in the aforesaid image forming apparatus, there are nevertheless certain inherent disadvantages which are described hereinafter.

That is, because a pair of registration rollers is supported on the frame, a sheet feed error may occur when the transfer material is gripped between said pair of registration rollers, whereupon in an extremely inconvenient operation the entire frame must be pulled from the apparatus and the registration rollers manually rotated so as to extract the jammed sheet from therebetween.

Further, when the frame is installed in the apparatus, a drive force supplied by a drive motor mounted in the apparatus is received at one location, and said drive force is then transmitted to the photoconductive drum and the developing roller of the developing means. Thus, problems arise when a load is applied to the developing roller of the developing means and the like, because the variation induced by said load is directly transmitted to the photoconductive drum and dislocation is produced by the rotation of said photoconductive drum.

SUMMARY OF THE INVENTION

A main object of the present invention is to provide an improved image forming apparatus which eliminates the previously described disadvantages.

A further object of the present invention is to provide an image forming apparatus which maintains a constant positional relationship between the electrostatic latent image carrying member and the transport roller that transports the transfer material, maintains constant rotational speed, and allows easy processing to remove a sheet jammed.

A still further object of the present invention is to provide an image forming apparatus wherein the various components within an imaging unit that receive a drive force from the apparatus side do not mutually exert influence induced by an applied load on other components.

These objects are accomplished by the image forming apparatus of the present invention which comprises an image bearing member, process means for acting on the surface of said image bearing member, a pair of rollers for transporting a recording sheet to a position confronting said image bearing member where a toner image is transferred on the recording sheet, and a casing mountable into and demountable from a main assembly of said image forming apparatus, said casing integrally supporting the image bearing member, the process means and one of said pair of rollers.

These objects are further accomplished by the image forming apparatus of the present invention which comprises an image bearing member, developing means for developing a latent image formed on said image bearing member, driving means for generating driving force provided in a main assembly of said image forming apparatus, first driving force receiving member for receiving the driving force transmitted to the image bearing member, second driving force receiving member for receiving the driving force transmitted to the developing means, a casing detachably supported in the main assembly, said casing integrally supporting the image bearing member, the developing means, first driving force receiving member and second driving force receiving member, and driving force transmitting means for transmitting the driving force of the driving means to said first and second driving force receiving members.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENT

First Embodiment

Figure 1:
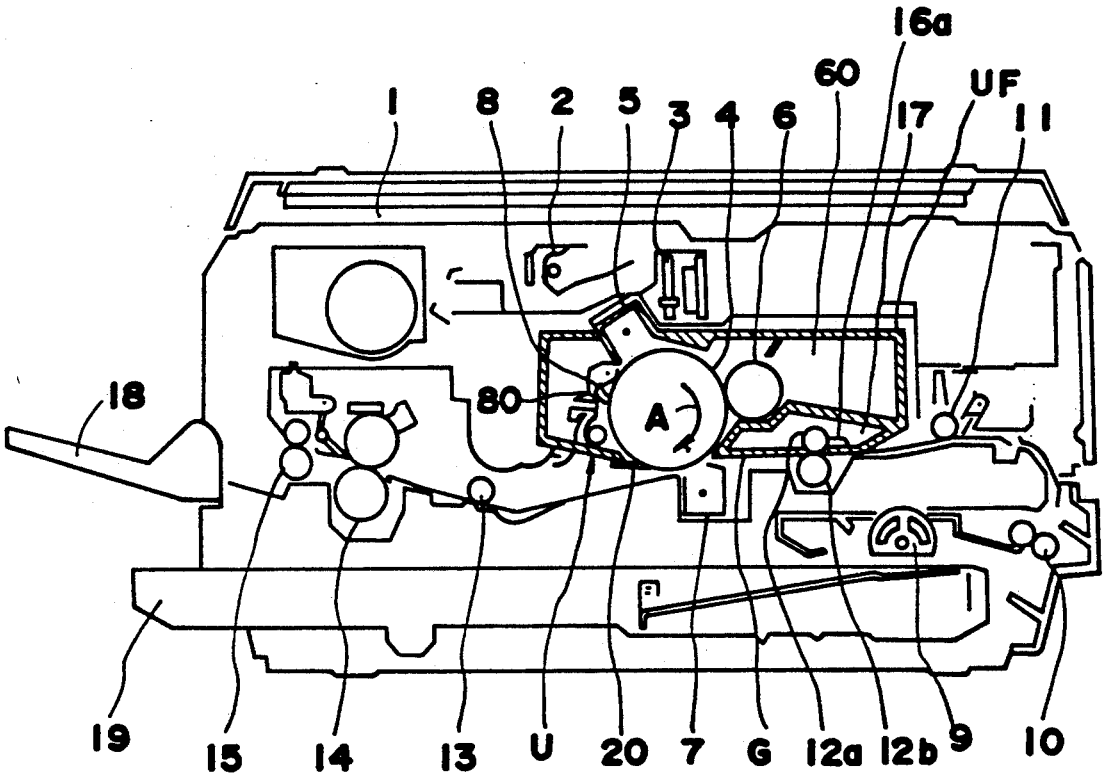
FIG. 1 is a brief section view of a copying machine embodying an image forming apparatus of the present invention.
Figure 2:
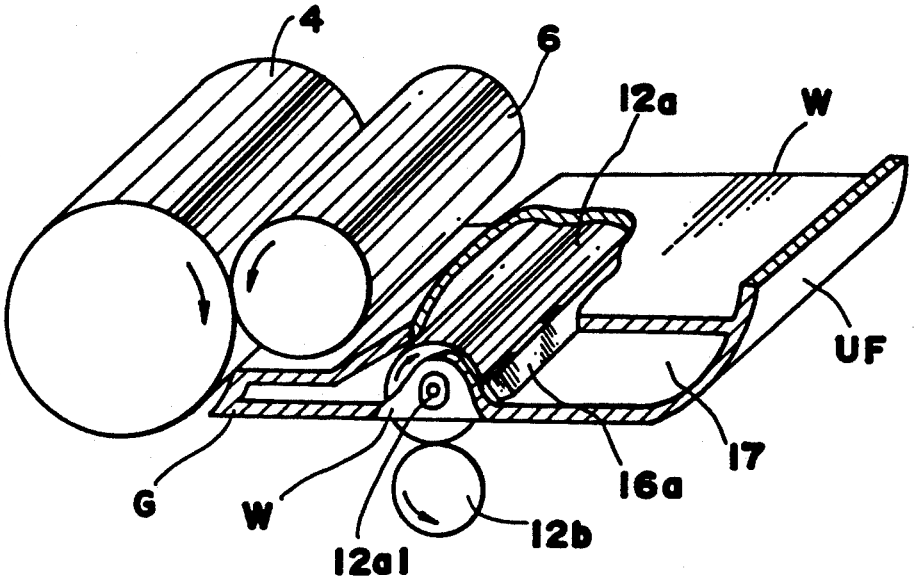
FIG. 2 is a partial section perspective view of the imaging unit installed in the copying machine shown in FIG. 1.

FIG. 1 shows the essential parts of a copying machine of one embodiment of the image forming apparatus of the present invention. FIG. 2 is a broken-out section view in perspective showing a part of the imaging unit.

The aforesaid copying machine provides an imaging unit located in the center section of the machine. The aforesaid imaging unit U has a photoconductive drum 4 as an electrostatic latent image carrying member that is drivably rotated in the arrow [A] direction in the drawing. Arranged around the periphery of photoconductive drum 4 are a charger 5 that functions as a process means, a developing unit 60 that includes a developing sleeve 6, a cleaner 80 that includes a cleaning blade 8, and a separation pawl 20 for separating the transfer sheet from the photoconductive drum 4.

Unit U also provides a registration roller 12*a* disposed above a roller 12*b* that is not a part of unit U to form a pair of registration rollers, a paper debris removing blade 16*a* that removes paper debris adhering to the surface of the aforesaid roller 12*a*, a collecting vessel 17 for collecting the paper debris removed by blade 16*a*, and a pretransfer guide G extending from the top side of registration roller 12*a* toward photoconductive drum 4.

Top registration roller 12*a* is arranged within an empty space partitioned by unit frame UF so as to have a part of said roller 12*a* facing downward beyond the empty space; the aforesaid paper debris removing blade 16*a* also is arranged within the aforesaid empty space. The aforesaid empty space at the right of the drawing behind blade 16*a* is the paper debris collecting vessel 17. Rotational shaft 12*a*1 of top registration roller 12*a* extends across pretransfer guide G from both sides of the paper debris collecting vessel 17 and is rotatably supported by member W that is integrated to extend to the roller center position. Member W and pretransfer guide G form an integrated unit.

Paper debris removing blade 16*a* has a film-like configuration and makes contact with the leading edge of top registration roller 12*a* so as to normally rub on the surface of top registration roller 12*a* and thereby remove the paper debris adhering to the surface of said roller 12*a*.

The bottom registration roller 12*b* of registration roller pair comprising rollers 12*a* and 12*b* is rotatably supported by the copying machine unit itself.

Imaging unit U is removable from the copying machine in the perpendicular direction relative to sheet surface, as shown in FIG. 1. This copying machine is a type which can be opened by operating the top part of the frame relative to the bottom part of the frame, with imaging unit U being installed in the top part of the copying machine frame. Accordingly, the top registration roller 12*a* can be separated from the bottom registration roller 12*b* by opening the copying machine by lifting the top part of the copying machine frame relative to the bottom part of said frame.

The copying machine provides a glass document platen 1 disposed above imaging unit U and reciprocatingly driven in the horizontal direction. Beneath glass document platen 1 are arranged an exposure lamp 2 for exposing the original document and a lens array 3 for projecting the light reflected from the original document onto photoconductive drum 4.

Transfer charger 7 is disposed beneath photoconductive drum 4.

Bottom registration roller 12*b* is disposed beneath top registration roller 12*a*, as previously described. An intermediate roller 11 is disposed on the upstream side of the aforesaid pair of registration rollers. The separation pawl 20 for separating the transfer sheet from photoconductive drum 4 is arranged at the side of said drum 4, and a transport roller 13, fixing rollers 14, discharge roller 15 and tray 18 are sequentially arranged on the downstream side of said separation pawl 20. A paper supply cassette 19 is removably installed in the bottom of the copying machine.

In the above described copying machine, an original document disposed on top of the glass document platen 1 is exposed by the aforesaid exposure lamp 2 and the document image is projected through lens array 3 onto the surface of photoconductive drum 4. The resulting electrostatic latent image formed on the surface of photoconductive drum 4 is developed by developing device 60 and the resulting toner image is transported to the transfer section having transfer charger 7. On the other hand, transfer sheets accommodated in paper supply cassette 19 are pulled out sheet by sheet by means of feed roller 9 pass by intermediate rollers 10 and 11 and arrive at the pair of registration rollers 12*a* and 12*b*, then are transported toward the transfer section synchronously with the toner image formed on the surface of photoconductive drum 4.

The toner image formed on the surface of photoconductive drum 4 is transferred to the surface of the transported transfer sheet by means of transfer charger 7. Thereafter, the aforesaid transfer sheet is separated from the surface of photoconductive drum 4 by separation pawl 20 and passes by roller 13 and fixing rollers 14, and after the toner image is fused to the transfer sheet, said transfer sheet is discharged to discharge tray 18 by discharge rollers 15. After the toner image is transferred, the surplus residual toner remaining on the surface of the photoconductive drum 4 is removed therefrom by means of cleaning blade 8.

In the previously described image forming process, the paper debris adhering to the top surface, to wit, the image transfer surface, of the transfer sheet transported toward the pair of registration rollers 12*a* and 12*b* adheres to the top registration roller 12*a* and is then removed therefrom by paper debris removing blade 16*a*. The paper debris adheres to blade 16*a*, then is deposited in paper debris collecting vessel 17.

The top registration roller 12*a* also is replaced when replacing imaging unit U with a new unit. Accordingly, replacement the imaging unit U eliminates the operation of removing paper debris from the registration roller, unlike the pair of registration rollers in conventional copying machines.

Further, when a jam occurs while a transfer sheet is gripped between the registration roller pair 12a and 12b, the jam can be readily corrected by opening the top part of the copying machine frame relative to the bottom part of the frame, thereby separating the top registration roller 12a contained in the imaging unit U from the bottom registration roller 12 contained in the main unit of the copying machine.

Second Embodiment

Figure 3:
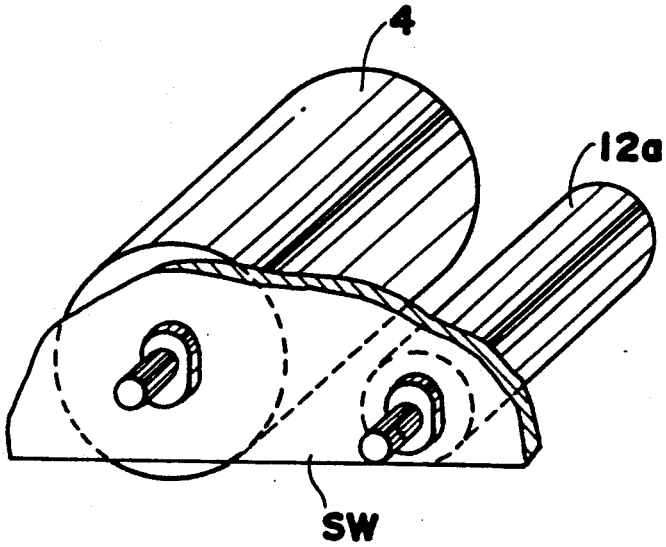
FIG. 3 is a partial perspective view of another example of an imaging unit.

FIG. 3 shows a portion of the imaging unit in the second embodiment thereof.

In the second embodiment, photoconductive drum 4 and top registration roller 12a are supported as a single integrated member. In this embodiment, the aforesaid integrated member combines side walls SW at the front and interior sides of imaging unit U (only the front side is shown in FIG. 3).

Thus, when photoconductive drum 4 and top registration roller 12a are supported by integrated members SW, the axial base between photoconductive drum 4 and top registration roller 12a is precisely determined, thereby markedly improving transfer accuracy.

Third Embodiment

Figure 4:
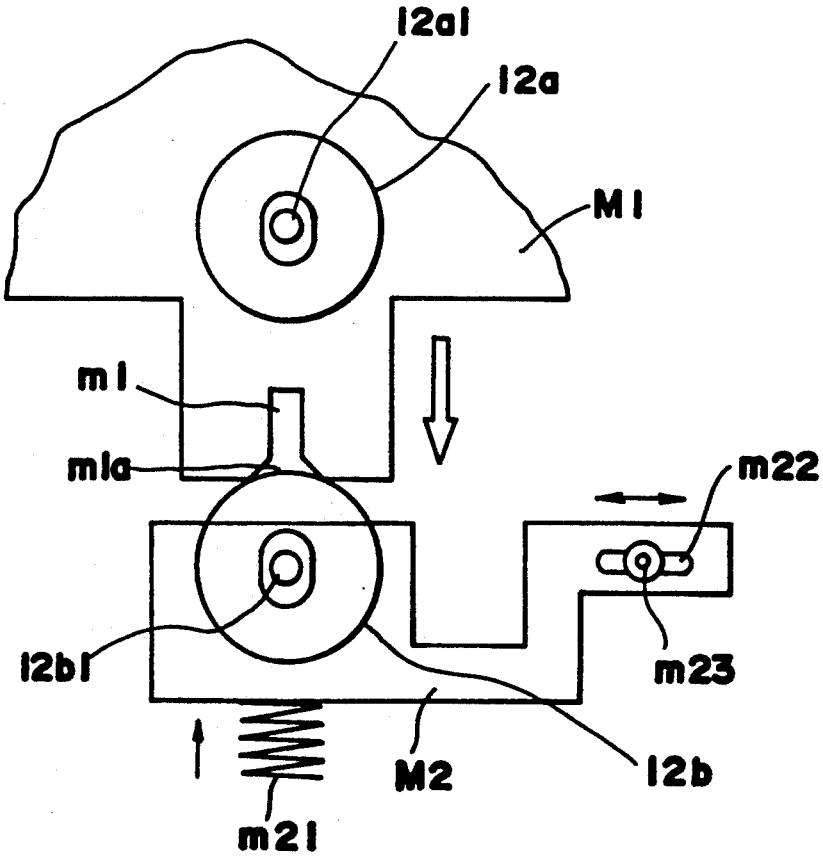
FIG. 4 is a partial perspective view of another example of an imaging unit.

FIG. 4 shows a portion of the third embodiment of the invention.

In the third embodiment, imaging unit U is provided a pair of guide member Ml at both sides of top registration roller 12a and fixedly attached to unit frame UF, while the bottom registration roller 12b installed on the copying machine side is supported so as to be vertically and horizontally movable at right angles relative to the roller axis, as shown in FIG. 4. In this embodiment, the imaging unit is installed in a specified position with the top frame portion of the copying machine in the open state, and the aforesaid pair of guide members M1 position the top registration roller 12a at a standard position relative to bottom registration roller 12b when the top frame portion of the copying machine is thereafter closed.

More specifically, each guide member M1 is a plate shaped member, as shown in FIG. 4, the bottom edge of which is provided a channel ml having the same width as the diameter of rotating shaft 12b1 of bottom registration roller 12b. On the other hand, the shaft 12b1 of bottom registration roller 12b is rotatably supported by one end of plate shaped member M2. One end of member M2 is supported from below by compressed coiled spring m21, and the other end of member M2 is supported by slidable pin m23 which is slidable in slot m22 formed at said other end of member M2. The bottom end of spring m21 is supported by the copying machine itself, and pin m23 also is supported by the copying machine itself. Therefore, member M2 is slightly movable in the vertical and horizontal directions while supporting bottom registration roller 12b.

According to the above described embodiment, the imaging unit is set in the top frame of the copying machine when the top frame portion of the copying machine is open, and when the top frame portion of the copying machine is closed shortly thereafter, shaft 12b1 is guided to the entrance guide m1a of channel m1 so as to have said shaft 12b1 of bottom registration roller 12b engage with channel m1 of top guide member M1. Bottom registration roller 12b is moved and the position of shaft 12b1 of bottom roller 12b is directed to the standard position by channel ml of top guide member M1. Top and bottom registration rollers 12a and 12b make mutual pressure contact through the action of spring m21.

According to the aforesaid embodiment, bottom registration roller 12b on the copying machine side may be mounted with some allowance, and the imaging unit guide member M1 accurately determines parallel placement of bottom registration roller 12b relative to top registration roller 12a, thereby preventing diagonal travel of the transfer sheet.

Fourth Embodiment

Figure 5:
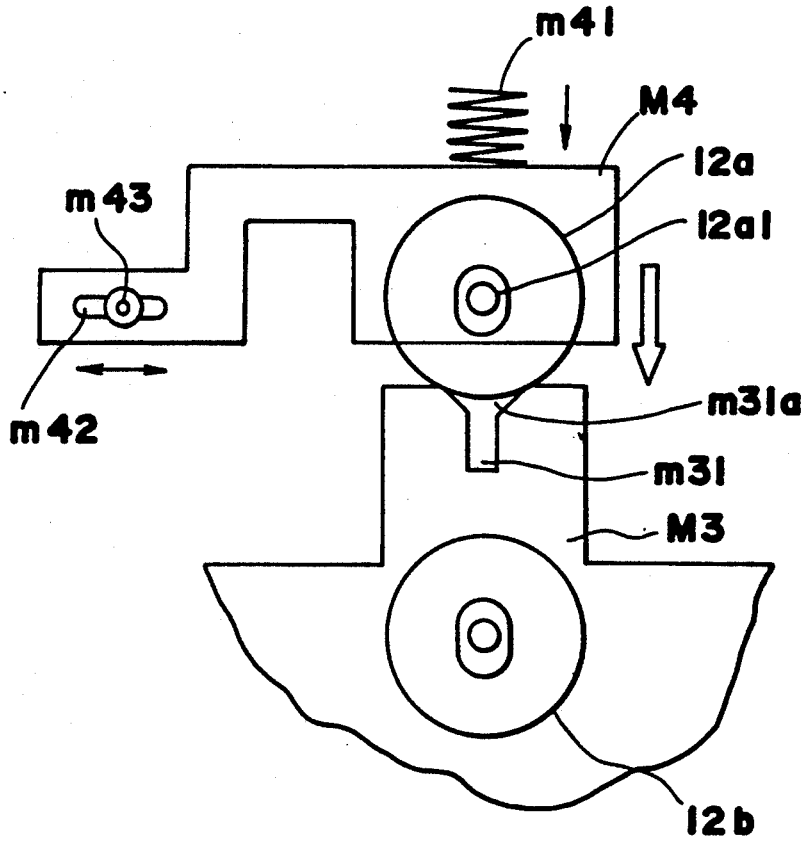
FIG. 5 is a partial perspective view of another example of an imaging unit.

The fourth embodiment of the invention is shown in FIG. 5 and has the opposite relationship to that described in the third embodiment. That is, top registration roller 12a is supported by imaging unit U so as to be movable vertically and horizontally, and bottom registration roller 12b installed on the copying machine side is provided guide members M3 at both ends. Shaft 12a1 of top registration roller 12a is rotatably supported at one end by plate-like member M4. The top of one end of the aforesaid plate-like member M4 receives a force exerted by a compressed coil spring m41, and the other end is slidably supported by pin m43 which is slidable in slot m42 formed on the end of member M4. Although not shown in the drawing, the top end of spring m41 makes contact with the unit frame UF, and pin m43 is fixedly attached to unit frame UF.

The top end of guide members M3 attached at both ends of bottom registration roller 12b are provided channels m31 that engage shaft 12a1 of top roller 12a.

In the present embodiment, the imaging unit is set in the top half of the copying machine when the copying machine is in the open state, and when the copying machine is closed, shaft 12a1 is guided to the entrance guide m31a of channel m31 so as to have said shaft 12a1 of to registration roller 12a engage with channel m31 of bottom guide member M3. Top registration roller 12a is moved and the position of shaft 12a1 of top roller 12a is directed to the standard position by channel m31 of top guide member M3. Top and bottom registration rollers 12a and 12b make mutual pressure contact through the action of spring m41.

The present embodiment also has the advantage of preventing diagonal travel of the transfer sheet by eliminating twisting between the registration roller pair in a similar manner to that of the embodiment shown in FIG. 4.

Fifth Embodiment

Figure 6:
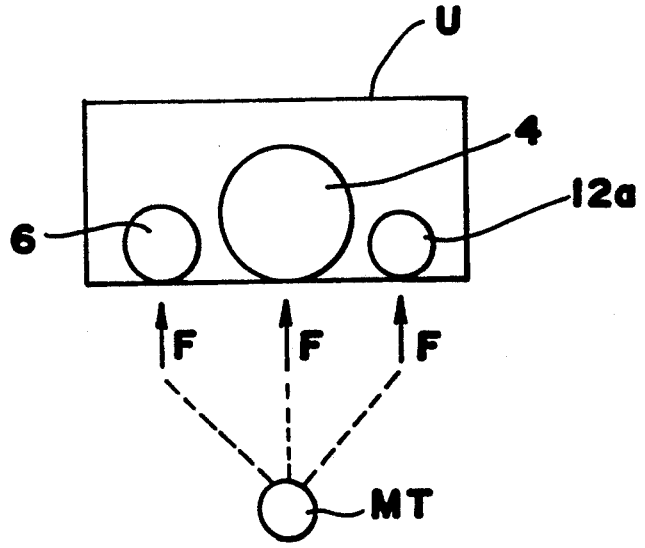
FIGS. 6 through 9 are illustrations of the drive force transmission path of the imaging unit.
Figure 7:
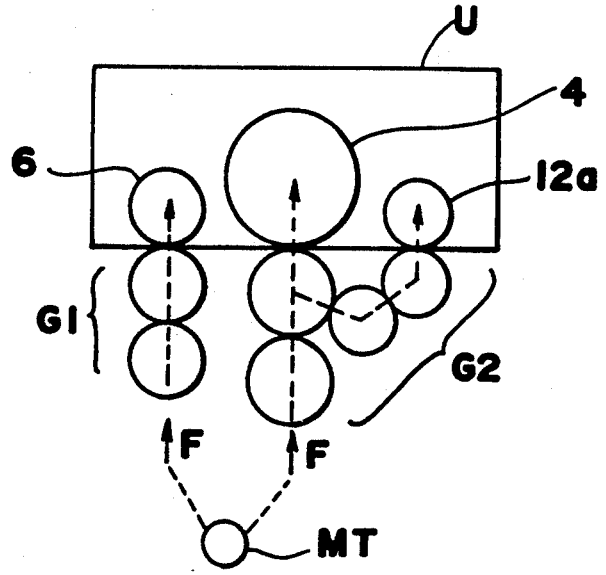
Figure 9:
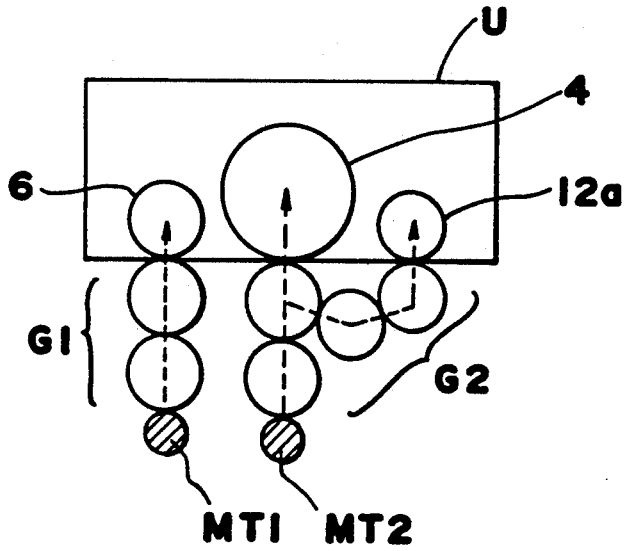

The fifth embodiment has an imaging unit U with a plurality of drive power receiving portions to receive drive power from the main motor, as shown in FIGS. 6, 7 and 9.

Figure 10:
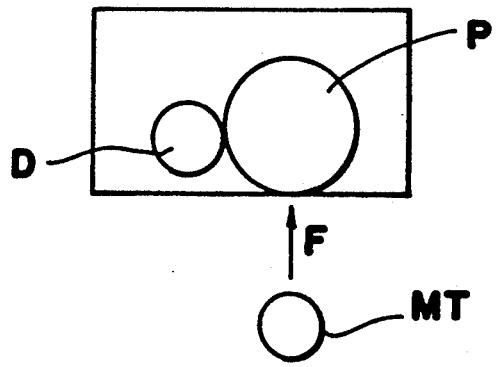
FIG. 10 is an illustration of a conventional drive force transmission path of an image forming process unit.

FIG. 10 is a brief illustration showing the drive force transmission state of the main motor in a conventional imaging unit. The imaging unit is provided a receiving portion at only one location for receiving drive force F from the main motor. In the example shown in the drawing, the receiving portion is disposed opposite the photoconductive drum P, such that drum P receives the drive force and divides said force from drum P to developing device D. According to the aforesaid construction, photoconductive drum P and developing device D form the same drive system.

Accordingly, an oscillation is transmitted to photoconductive drum P by the drive of developing device D which has an extremely heavy load compared to the drive of drum P, resulting in the disadvantage of producing a slippage in synchronicity between said drum P and developing device D.

In the present embodiment, the imaging unit U has, for example, three drive force receptor portions: a drive force receptor portion of developing device 60 to receive the drive force F of the main motor MT, a drive force receptor portion of photoconductive drum 4, and drive force receptor portion for top registration roller 12*a*, as shown in FIG. 6. According to the aforesaid construction, developing sleeve 6 of developing device 60, which has an extremely heavy load compared to photoconductive drum 4 and top registration roller 12*a*, is not affected by the drive, thereby maintaining synchronicity in imaging unit U, and improving accuracy of the transfer of toner image on drum 4 to the transfer sheet.

In the example shown in FIG. 7, drive force receptor portions for receiving a drive force from the main motor are provided to both the photoconductive drum 4 and developing device 60. The drive force transmitted to developing device 00 is transmitted to developing sleeve 6 of developing device 60 by means of a gear train G1, and the drive force transmitted to photoconductive drum 4 is transmitted to photoconductive drum 4 and top registration roller 12*a* by a separate gear train G2. Details of the aforesaid drive force receptor portions at three locations are shown in FIG. 8.

Figure 8:
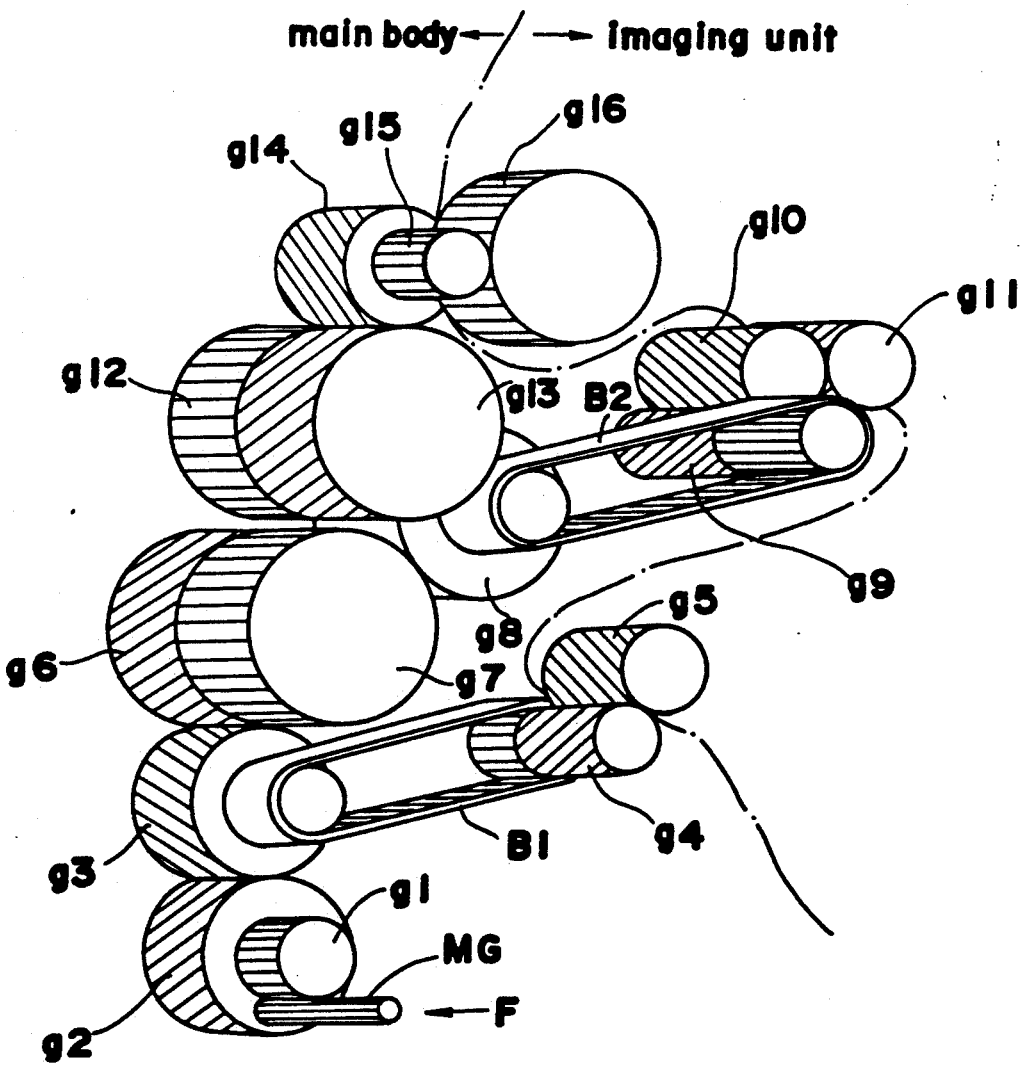

In FIG. 8, a part of the drive force F of the main motor is transmitted from main motor shaft MG through gear train g1 to g3, belt transmission B1 and gear g4 to gear g5 which is directly coupled to developing sleeve 6 of developing device 60. Further, the remainder portion of drive force F is transmitted through gear train g1, g2, g3, g6, g7, g8 and belt transmission B2, and gear train g9 and g10 to gear g11 which is directly coupled to top registration roller 12*a*, and is also transmitted from gear g8 through gear train g12, g13, g14 and g15 to gear g16 which is directly coupled to photoconductive drum 4. Developing device 60, photoconductive drum 4 and top timing roller 12*a* are driven smoothly without being influenced by other drives through the use of belt transmissions B1 and B2.

Developing device 60 as well as photoconductive drum 4 and top timing roller 12*a* may also be driven by separate drive motors MT1 and MT2, as shown in FIG. 9.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:

a housing mountable into and demountable from a main assembly of said image forming apparatus;

an image bearing member in said housing;

process means for acting on the surface of said image bearing member in said housing;

a pair of rollers for transporting a recording sheet to a position confronting said image bearing member where a toner image is transferred on the recording sheet, wherein one of said pair of rollers is connected in said housing and another of said pair of rollers is connected in said main assembly;

support means disposed on said main assembly for supporting the another of said pair of rollers; and a guide portion formed on said housing for receiving and guiding the another of said pair of rollers in relation to the one of said pair of rollers when said housing is mounted in an operative position, whereby both of said pair of rollers are properly aligned with respect to each other.

2. An image forming apparatus according to claim 1, wherein said guide portion is a groove capable to hold an axis of the another of said pair of rollers.

3. An image forming apparatus according to claim 2, further comprising:

press means for pressing the another of said pair of rollers toward the one of said pair of rollers.

4. An image forming apparatus according to claim 1, wherein the support means is movable.

5. An image forming apparatus according to claim 1, wherein said guide portion receives an axis of the another of said pair of rollers.

6. An image forming apparatus comprising:

a housing mountable into and demountable from a main assembly of said image forming apparatus;

an image bearing member in said housing;

process means for acting on the surface of said image bearing member in said housing;

a pair of rollers for transporting a recording sheet to a position confronting said image bearing member whereas a toner image is transferred on the recording sheet, wherein one of said pair of rollers is connected in said housing and another of said pair of rollers is connected in said main assembly;

support means disposed on said housing for supporting the one of said pair of rollers; and a guide portion formed on said main assembly for receiving and guiding the one of said pair of rollers in relation to the another of said pair of rollers when said housing is mounted in an operative position, whereby both of said pair of rollers are properly aligned with respect to each other.

7. An image forming apparatus according to claim 6, wherein said guide portion is a groove capable to hold an axis of the one of said pair of rollers.

8. An image forming apparatus according to claim 6, wherein the support means movably supports the one of said pair of rollers.

9. An image forming apparatus according to claim 6, wherein said guide portion receives an axis of the one of said pair of rollers.

* * * * *